US005394580A

United States Patent [19]

Foster et al.

[11] Patent Number: 5,394,580

[45] Date of Patent: Mar. 7, 1995

[54] HOSPITAL BED WITH THREE POSITION PATIENT SIDE GUARDS

[75] Inventors: L. Dale Foster, Brookville; John W. Ruehl, Shelbyville, both of Ind.

[73] Assignee: Hill-Rom Company, Inc., Batesville, Ind.

[21] Appl. No.: 76,254

[22] Filed: Jun. 11, 1993

[51] Int. Cl.[6] ..... A61G 7/00; A47C 21/08

[52] U.S. Cl. ..... 5/620; 5/430

[58] Field of Search ..... 5/430, 428, 425, 429, 5/600, 185, 620

[56] References Cited

U.S. PATENT DOCUMENTS

| | | | |
|---|---|---|---|
| 2,284,470 | 5/1942 | Comper et al. . | |
| 2,786,214 | 3/1957 | Armstrong . | |
| 3,585,660 | 6/1971 | Gottfried et al. | 5/430 |
| 3,930,273 | 1/1976 | Stern . | |
| 3,958,283 | 5/1976 | Adams et al. . | |
| 4,002,330 | 1/1977 | Johansson . | |
| 4,206,525 | 6/1980 | Williams . | |
| 4,234,982 | 11/1980 | Bez et al. | 5/424 |
| 4,486,908 | 12/1984 | Schroeder | 5/430 |
| 4,612,679 | 9/1986 | Mitchell | 5/430 |
| 4,653,129 | 3/1987 | Kuck et al. | 5/430 |
| 4,669,136 | 6/1987 | Waters et al. | 5/185 |
| 4,747,171 | 5/1988 | Einsele et al. | 5/430 |
| 4,967,431 | 11/1990 | Hargest et al. | 5/453 |
| 4,985,946 | 1/1991 | Foster et al. | 5/430 |
| 4,987,623 | 1/1991 | Stryker et al. | 5/430 |
| 5,023,967 | 6/1991 | Ferrand | 5/430 |
| 5,054,141 | 10/1991 | Foster et al. . | |
| 5,077,843 | 1/1992 | Foster et al. | 5/185 |
| 5,083,332 | 1/1992 | Foster et al. | 5/185 |
| 5,129,117 | 7/1992 | Celestina et al. | 5/430 |
| 5,179,744 | 1/1993 | Foster et al. | 5/600 |

FOREIGN PATENT DOCUMENTS

| | | |
|---|---|---|
| 141382 | 7/1921 | United Kingdom . |
| 189572 | 12/1922 | United Kingdom . |

*Primary Examiner*—Alexander Grosz

*Attorney, Agent, or Firm*—Wood, Herron & Evans

[57] ABSTRACT

A hospital bed has a frame mounted on a base which includes castors. Side guards are mounted on the bed frame. The side guards are inwardly moveable and releasably lockable to narrow the hospital bed. The frame has a cam block with a recess. A latching arm is pivotally connected to linkage connecting the side guard to the frame and has a handle and a cam roller follower. The handle is rotated to move the side guard inwardly; when the roller follower engages the recess the side guard is locked in the inward position. The side guards are moveable and releasably lockable toward the foot end of the bed. A spring biased plunger on the linkage projects through a hole in a plate on the linkage. The side guards are releasably lockable in an intermediate position. The spring biased plunger projects through a hole in the cam block.

26 Claims, 4 Drawing Sheets

3
16a
28
26
30b
32
36
38a
40
42
38b
39
38
48
34
4
28
4
16
50
12
30a
29
3

20
28
30b
26
38
28
24
30a 20
30b
28
24
26
38
28
30a 24
28
26
22
33
34
46
44
23
31
26
20
32
36
12
38a
48
42
39
40
38b
38

HOSPITAL BED WITH THREE POSITION PATIENT SIDE GUARDS

FIELD OF THE INVENTION

This invention relates to a hospital bed, and more particularly, to a hospital bed that is both convertible between a full size hospital bed that is about 42 inches in width and a narrow hospital bed that is about 34 inches in width and one which is equipped with patient side guards which are securable in three different positions alongside the bed.

BACKGROUND OF THE INVENTION

A hospital bed has a base with castors on it so that it can be moved about. A frame is mounted on the base and overlying it is a patient support surface and a mattress on which the patient is situated. Alongside the patient support surface and the mattress are patient guards that project above the mattress on each side of the bed to keep the patient from inadvertently sliding out of the bed.

A typical hospital bed provided in a patient's room is about 42 inches wide. Although many diagnostic procedures and examinations can be conducted in a patient's resident room without displacing the patient from the hospital bed, very often the patient must be moved from room to room in the course of diagnosis, treatment, recuperation, or the like. To accomplish this currently, the patient must physically be transferred from the standard width hospital bed to a stretcher size narrow width bed for transport within the hospital. Once the procedure or examination is completed and the patient returned to the resident room, he must be physically transferred back to the standard hospital bed. The repeated shifting from bed to bed is both inherently unsettling and potentially injurious for the patient while labor intensive for the nurse or care provider.

A prior solution to these problems is disclosed in U.S. Pat. No. 4,985,946 assigned to the assignee of the present invention. In U.S. Pat. No. 4,985,946 a hospital bed has a patient head guard on each side of the bed. The head guard is connected to a bed frame by a parallelogram linkage which can be latched at a laterally inward position, thereby narrowing the bed for transport. The head guard is latched at the inward position by a spring loaded pin mounted on the bed frame which engages a slot in a latch plate interconnected to the head guard. When latched at the inward position, the bed guard of U.S. Pat. No. 4,985,946 narrows the hospital bed and still offers protection for the patient during transport.

An additional problem with typical hospital beds having patient side guards is that the patient guards cannot be moved to and secured at conveniently functional positions alongside, or along the length, the bed. Frequently a physician, nurse or care provider requires access to the patients' head or upper torso region for examination or treatment purposes and the patient guard obstructs or hinders this access. Furthermore, hospital beds commonly have the capability of being reconfigured into a chair position or at a minimum having a head panel raised to allow the patient to comfortably sit-up in bed. With the bed in an upright or chair position, the patient guards no longer provide the same level of protection to the patient because they are fixed in a position too far toward the head end of the bed, that is to say, the patient's torso has translated, through pivoting of the head panel of the bed toward the foot end of the bed, while the patient guard has remained fixed nearer the head end of the bed. When convening the bed to a chair or raising the bed to an upright position, the patient is shifted toward the foot end of the bed and is afforded less protection from the fixed patient guards.

Likewise, a control panel for calling a nurse, adjusting the bed, and numerous other functions is commonly situated on the patient side guard. When the patient is in an upright or seated position, these controls mounted to a fixed patient guard are not easily accessible or within reach for the patient.

SUMMARY OF THE INVENTION

A principal objective of the present invention is to provide a hospital bed with patient side guards which can be moved between and secured at three positions alongside the bed.

Another objective of the present invention is to improve upon the mechanism disclosed in U.S. Pat. No. 4,985,946 in providing a bed that can be either a full size bed with all the attendant comforts of the full size bed, or a narrow 34 inch width stretcher size bed, the bed being narrow for the specific purpose of transporting a patient from place to place.

Such a bed, convertible between full size and narrow stretcher size widths, makes possible the convenient maintaining of the patient while being transported to and from rooms other than the patient's resident room for performing various required procedures. Such a convertible bed eliminates the trauma of shifting the patient from bed to stretcher and back again. If, however, transfer from the bed to an operating room table or similar structure is necessary, the patient is more conveniently in reach of the attending nurses and care providers if the bed is narrowed to 34 inches, thereby minimizing the strain of leaning over the bed to transfer the patient from the bed to another support surface.

The objective of the invention of providing a full size width hospital bed which is convertible to a narrow stretcher width bed while maintaining the protection afforded by the patient guards is attained by providing patient guards which are inwardly pivotable to narrow the width of the bed. Patient guards repositioned inwardly about four inches on each side of the bed create a stretcher width bed with full side guard protection.

A further objective of the invention is to provide a hospital bed with patient guards which can be shifted toward a foot end of the bed and locked in position there. Repositioning the patient guard toward the foot end provides better thoroscopy access when using specialized diagnostic equipment such as a C-arm or mobile radiographic/fluoroscopic unit in administering to a patient situated atop the bed. Additionally, shifting the patient guard to the foot end provides more protection at the foot end if the bed is in a chair position and offers better access to the control panel located on the patient guard when the bed is in an upright position.

The present invention contemplates patient guards mounted on each lateral side of the hospital bed. Each side guard is mounted on a carriage which is connected to the bed frame by a four bar parallelogram linkage. The parallelogram linkage consists of the carriage and two generally parallel links pivotably attached to the carriage at one end of each link and the bed frame at an opposite end of each link.

In order to pivot the patient guards inwardly and thereby narrow the width of the hospital bed to the stretcher configuration of the present invention, a cam block is mounted on the bed frame adjacent a latching arm which is pivotably attached to the carriage. The cam block mounted on the bed frame has a cam edge surface with a notch or recess. The latching arm pivotably attached to the carriage has a cam roller follower mounted on the inboard end of the latching arm to engage the cam edge surface. On the end of the latching arm opposite from the cam roller follower is a handle with which a nurse or care provider may operate the present invention.

In operation, to convert the full width hospital bed to the narrow or stretcher width configuration, the nurse or care provider grasps the handle on the latching arm and rotates the latching arm about the pivot point connecting it to the carriage, thereby pivoting the cam roller toward the cam edge surface on the cam block. Once the cam roller engages the cam edge surface, the care provider continues to rotate the handle about the carriage causing the cam roller to translate along the cam edge surface, thereby collapsing the patient guard attached to the carriage laterally inwardly. The mattress on the hospital bed is deformable on the side edges proximate the patient guard permitting the carriage and patient guard to collapse inwardly.

Once the roller follower encounters the recess in the cam edge surface, it engages the recess, and thereby locks the patient guard at the inward position. After this procedure is repeated for the other side of the bed, the full width hospital bed has been narrowed by approximately four inches on each lateral side to provide a narrow width hospital bed or stretcher configuration. To return the hospital bed to the full width configuration, the nurse rotates the handle to disengage the cam roller follower from the recess in the cam block, thereby translating the patient guard outward and returning the hospital bed and mattress to the full width configuration.

In order to reposition and lock the patient guard toward the foot end of the bed and thereby provide better access to the patient's upper torso and head regions, the parallelogram linkage of the present invention pivots through approximately 180 degrees from the narrow bed width configuration. The patient guard is manually shifted toward the foot end of the bed until a spring loaded plunger mounted on the carriage engages a retention plate mounted to the link of the four bar parallelogram linkage closest to the foot of the bed. The retention plate includes an aperture through which the plunger is inserted to lock the side guard in position near the foot end of the bed. The plunger is slidably mounted to the carriage within a plunger bracket. A coil spring biases the plunger into an extended position projecting out of the lower end of the plunger bracket.

When the patient guard is swung toward the foot end, the plunger encounters the retention plate mounted to the link and forces the plunger to retract up into the plunger bracket by compressing the coil spring. The plunger slides over the upper surface of the retention plate until it is aligned with the aperture thereby allowing the coil spring to extend and bias the plunger into and through the aperture. As a result, the patient guard is locked toward the foot end of the bed providing patient protection, access for the patient to the control panel on the patient guard and care provider access at the head end of the bed. To release the patient guard for repositioning at the head end in either the narrow or standard width positions, the plunger is manually pushed upwardly and out of the retention plate aperture thereby disengaging the plunger from the retention plate allowing the patient guard to be freely shifted toward the head end.

In order for the plunger not to interfere with the operation of the cam block and cam roller follower, a release plate is mounted to the latching arm. The release plate engages and forces the plunger upwardly within the plunger bracket. As the latching arm is pivoted to convert the hospital bed to the narrow width configuration, the release plate maintains the plunger in the retracted position thereby ensuring that the spring loaded plunger will not inhibit the cam roller follower operation. An aperture is also provided in the cam block through which the plunger extends to secure the patient guard in the full width hospital bed configuration toward the head end of the bed. To release the patient guard from the full width hospital bed configuration, the latching arm is pivoted until the release plate engages the plunger thereby forcing it upwardly and out of the cam block aperture and into the plunger bracket permitting the patient guard to be shifted to either the inward position or toward the foot end of the bed.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
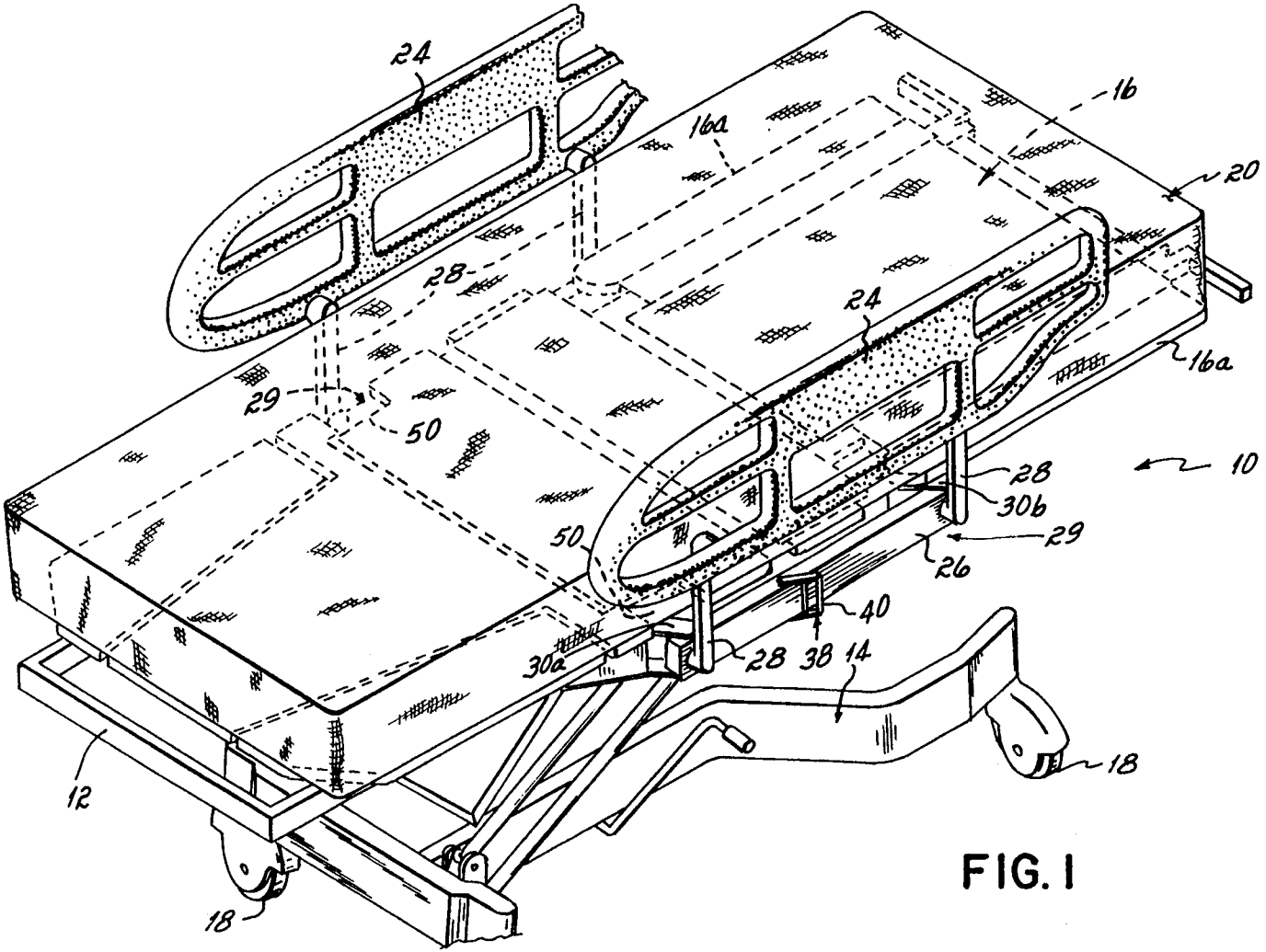
FIG. 1 is a diagrammatic perspective view of a hospital bed having a three position patient side guard according to the present invention.

Referring to FIG. 1, there is depicted a hospital bed 10 of the present invention including a bed frame 12 mounted on a base 14 and a patient support surface 16 mounted on the bed frame 12. The base has castors 18 so the bed can be moved from place to place. The patient support surface 16 supports a mattress 20 which is deformable on the side edges of the head end of the mattress.

Patient side guards 24, 24 are mounted adjacent to the head end of the mattress alongside the collapsible portions of the mattress. Each of the patient guards 24 is connected to a carriage 26 by a pair of links 28, 28. The carriage 26 is connected to the bed frame 12 by a parallelogram linkage 29 consisting of a pair of links 30*a*, 30*b* which are pivotably mounted to the carriage 26 and to the bed frame 12. More particularly, the carriage 26, the link pair 30*a*, 30*b*, and the bed frame 12 form the parallelogram linkage which enables the side guards 24 to transversely move inwardly and outwardly to narrow and widen the bed 10 and to shift longitudinally along the side of the bed 10.

Figures 1A, 1B, 2, 4:
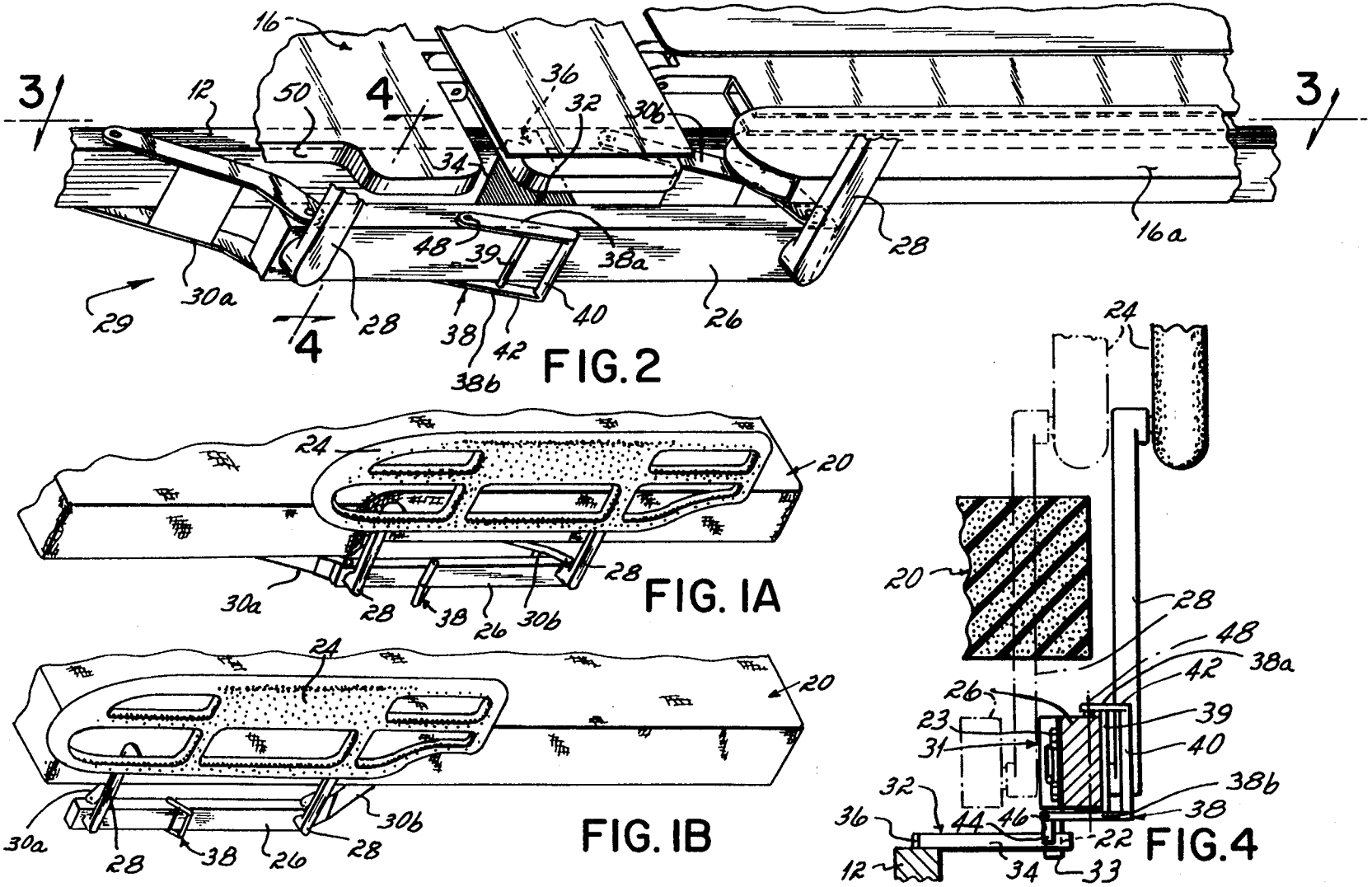
FIG. 1A is a partial diagrammatic perspective view of the of FIG. 1 with the patient guard at an inwardly pivoted position.
FIG. 1B is a view similar to FIG. 1A with the patient guard shifted toward a foot end of the bed.
FIG. 2 diagrammatic perspective view of a bed frame and linkage connecting the carriage to the hospital bed of the present invention.
FIG. 4 is a side view of the patient side guard of the present invention taken along line 4—4 of FIG. 2 showing the side guard repositioned inwardly in phantom.
Figure 3:
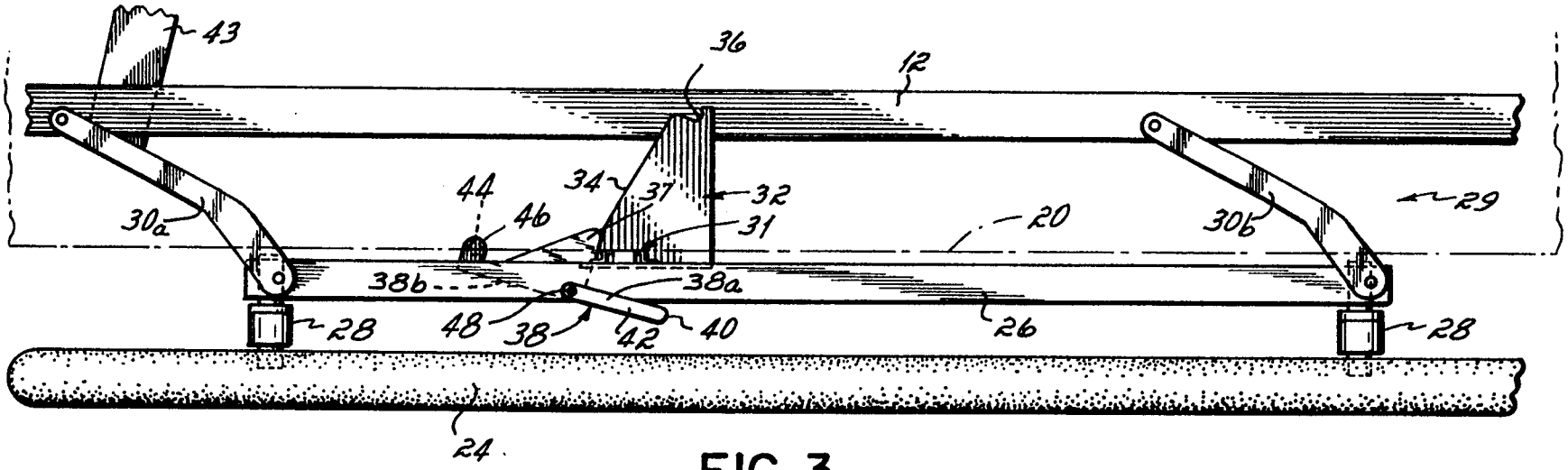
FIG. 3 is a diagrammatic plan view of the patient side guard of the present invention in the full hospital bed width configuration at the head end of the bed taken along line 3—3 of FIG. 2.
Figure 3A:
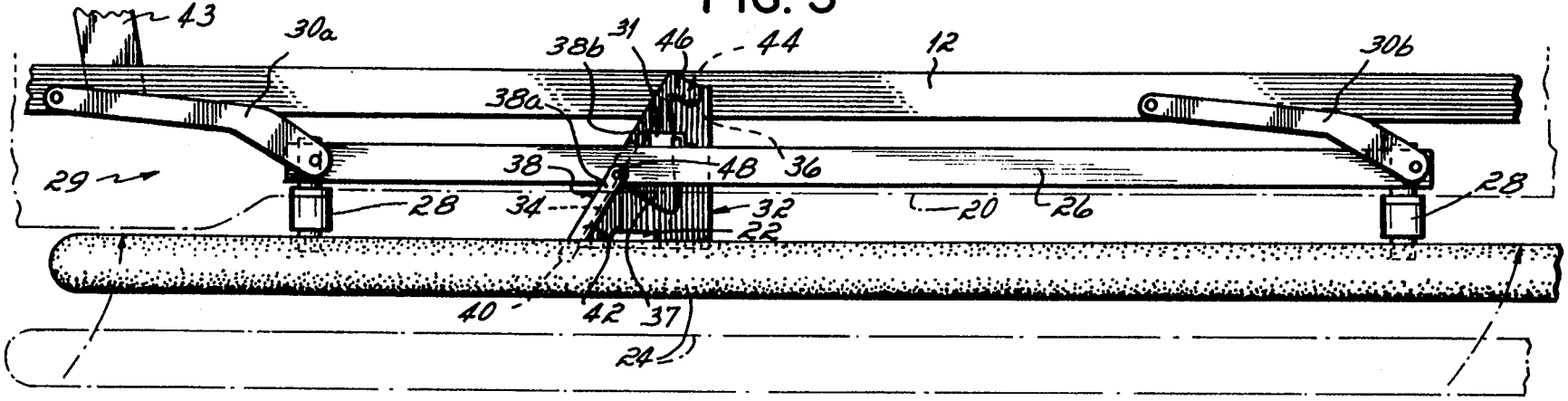
FIG. 3A is a diagrammatic plan view of the patient side guard of the present invention in the narrow hospital bed width configuration.
Figure 3B:
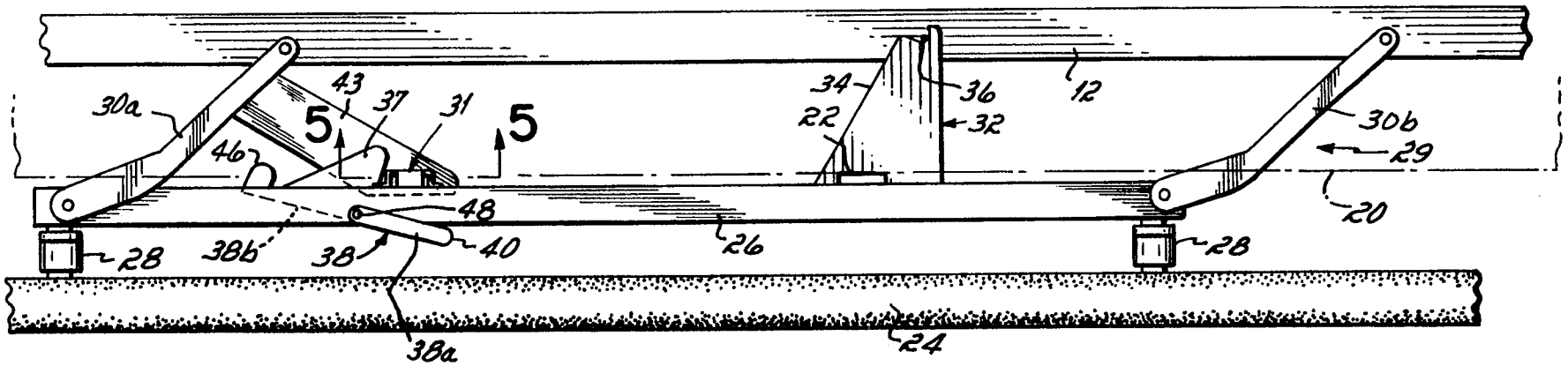
FIG. 3B is a view similar to FIG. 3A with the patient side guard shifted toward the foot end of the bed.

As shown in FIGS. 3, 3A and 3B, a cam block 32 which has a cam edge surface 34 with a recess 36 therein is mounted on the bed frame 12. Pivotably attached to the carriage 26 is a latching arm 38 which has a handle 40 on an outboard end 42 and a cam roller follower 44 rotatably mounted on an inboard end 46. The latching arm 38 includes an upper latching bar 38*a* and a lower latching bar 38*b* which are connected by a rod 39 positioned between the handle 40 and the carriage 26 as shown in FIG. 2. The upper latching bar 38*a* and the lower latching bar 38*b* are each pivotably mounted to opposite sides of the carriage 26 by a pivot pin 48.

Figure 5:
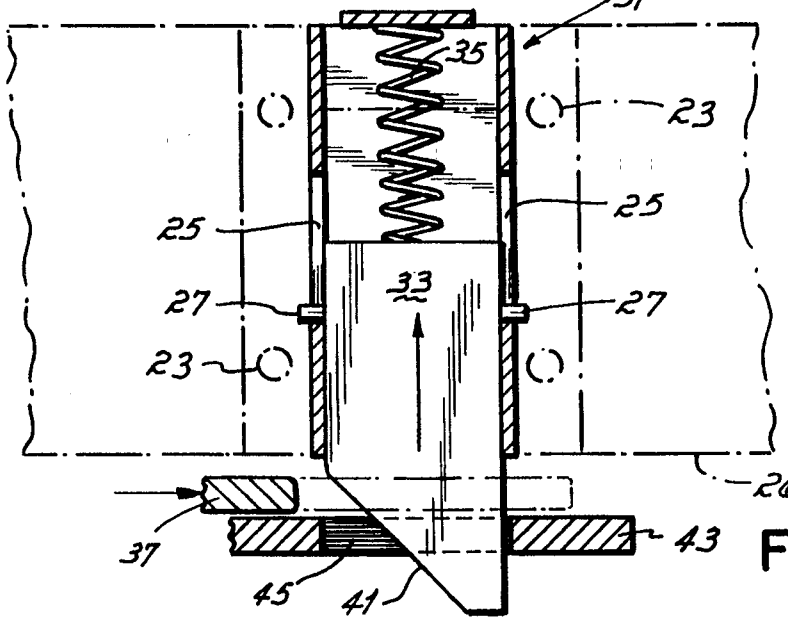
FIG. 5 is a cross sectional view taken along line 5—5 of FIG. 3B illustrating the plunger mechanism.

As best seen in FIG. 5 and visible in FIGS. 3, 3A, 3B and 4, a plunger bracket 31 is mounted to the inwardly facing side of the carriage 26 by screws 23. The plunger bracket 31 has a plunger 33 slidably mounted therein with a coil spring 35 biasing the plunger 33 toward a projected position extending out of the plunger bracket 31. The plunger 33 is slidably retained in the plunger bracket 31 by a pair of pins 27 on opposite sides of the plunger which project outwardly from the plunger 33 and into a pair of slots 25 in the plunger bracket 31. A release plate 37 is secured to the lower latching bar 38*b*. The release plate 37 engages a sloped edge surface 41 of the spring biased plunger 33 and thereby forces the plunger 33 to retract into the plunger bracket 31 by compressing the spring 35. The cam block 32 has a slotted hole 22 into which the plunger 33 extends to secure the patient guard 24 at the full width hospital bed configuration at the head end of the bed 10 as shown in FIG. 1.

A retention plate 43 is mounted to the lower portion of link arm 30*a*. The retention plate 43 has a slotted hole 45 into which the plunger 33 projects to releasably lock the patient guard 24 near the foot end of the bed 10. The release plate 37 is operable to force the plunger 33 up from either the retention plate hole 45 or the cam block 22 when engaged respectively therein.

In the operation of the present invention, the hospital bed 10 is about 42 inches wide in the full width configuration as shown in FIG. 1. The patient has the usual amount of room as, for example, a 34 inch wide patient surface 16, but the side guards 24 make the overall width of the hospital bed 10 about 42 inches. If a patient is to be transported, each side guard 24 is collapsed inwardly to narrow the hospital bed 10 to the overall width of about 34 inches while continuing to protect the patient thereon.

To collapse the side guard 24 inwardly, the nurse or care provider would rotate the handle 40 on the latching arm 38 about the pivot pin 48 connecting the latching arm 38 to the carriage 26. As the latching arm 38 is rotated, the release plate 37 contacts the plunger's sloped edge 41 and forces the plunger 33 up into the plunger bracket 31 thereby freeing the plunger 33 from the slotted hole 22 in the cam bracket 32 and preventing the plunger 33 from interfering with the cam roller follower 44 operation. With the continued rotation of the latching arm 38, the cam roller follower 44 approaches and contacts the cam edge surface 34 on the cam block 32 mounted on the bed frame 12.

The cam roller 44 translates along the cam edge surface 34 as rotation of the latching arm 38 continues, thereby collapsing the carriage 26 and attached patient side guard 24 laterally inward. Once the cam roller follower 44 reaches and engages the recess 36 in the cam edge surface 34, the patient guard 24 is secured at the inward position, thereby collapsing each side of the hospital bed by approximately four inches. The mattress 20 is compressed as shown in FIG. 3A to accommodate the laterally inward movement of the patient guard 24 and carriage 26.

In order to accommodate the inward travel of side guard 24, and particularly links 28, 28 supporting each side guard 24, there is a relieved area 50 in the patient support surface 16 allowing foot end link 28 to move inwardly. In order to allow head end link 28 to similarly move inwardly, the lateral head end edges 16*a*, 16*a* of the patient support surface 16 are adapted to collapse inwardly, with the plane generally defined by the support surface 16, a sufficient distance. A preferable collapsible head end lateral edge or so-called "collapsing wing" is disclosed in a co-pending application Ser. No. 08/074,925, filed on Jun. 10, 1993 and assigned to the assignee of the present invention, the entire substance of which is hereby incorporated by reference herein.

The collapsing wing is positioned on a lateral side near the head end of the hospital bed. As the result of a laterally inwardly applied force, the wing collapses, thereby narrowing the width of the bed. The wing is attached to the bed frame by a spring loaded parallelogram linkage which permits the wing to move laterally within a generally horizontal plane as a result of the inward force. Once the inward force is removed, the parallelogram linkage may return the wing to the full width hospital bed configuration unless the patient side guards 24 are locked at the inward position.

To return the hospital bed 10 to the full width configuration, the nurse or care provider would disengage the cam roller 44 from the recess 36 by reverse rotation of the latching arm 38 from the handle 40. Once disengaged, the compressed mattress 20 would expand to its natural state and the carriage 26 moved laterally outwardly by the handle 40, returning the side guard 24 to the configuration shown in FIGS. 1 and 3.

As the side guard 24 returns to the normal bed width configuration, the release plate 37 pivots with the latching arm 38 and exposes the retracted plunger 33 allowing the spring 35 to extend and force the plunger 33 so as to project downwardly from and out of the plunger bracket 31 and into the slotted hole 22. To shift the side guard 24 toward the foot end of the bed 10 to allow, for example, more access to the patient's upper torso and head regions or to offer more protection for the patient near the foot end of the bed, the plunger 33 must be retracted into the plunger bracket 31 either manually or with the release plate 37 by grasping the handle 40 and pivoting the latching arm 38 until the release plate 37 engages the sloped edge 41 and forces the plunger 33 upward. The side guard 24 is then pivoted longitudinally toward the foot end of the bed 10 manually. The links 30*a*, 30*b* connected to the bed frame 12 permit the side guard 24 to be pivoted in such a manner.

As the link arm 30*a* pivots from the position of FIG. 3 to that of FIG. 3B, the retention plate 43 attached to link 30*a* pivots likewise to approach the plunger bracket 31 and plunger 33 mounted on the carriage 26. The release plate 37 maintains the plunger 33 in the retracted position within the plunger bracket 31 until the plunger 33 is positioned over the retention plate 43. The latching arm 38 is then pivoted to allow the spring 35 to bias the plunger 33 into contact with the retention plate 43. The plunger 33 translates along the upper surface of the retention plate 43 until the pivoting of the side guard 24 toward the foot end of the bed 10 aligns the plunger 33 with the slotted hole 45 in the retention plate 43. When aligned with the plunger 33, the spring 35 extends and forces the plunger 33 through the hole 45 thereby securing the side guard 24 near the foot end of the bed 10. To release the side guard 24 and return it to the position shown in FIG. 3, the plunger 33 is manually depressed upwardly by moving plate 37 into engagement with slope 41 to withdraw the plunger 33 from the hole 45 and permit the side guard to be shifted back to the position of FIG. 3 or FIG. 3A as required.

With the side guard in the position shown in FIG. 3B, a further objective attained by the invention is to provide a hospital bed with patient guards which have been shifted toward a foot end of the bed and locked in position there. Repositioning the patient guard toward the foot end provides better thoroscopy access when using specialized diagnostic equipment such as a C-arm or mobile radiographic/fluoroscopic unit in administering to a patient situated atop the bed. Additionally, shifting the patient guard to the foot end provides more protection at the foot end if the bed is in a chair position and offers better access to controls located on the patient guard when the head end of the bed is in an upright position. The three-position side guards would be used, for example, in conjunction with the hospital bed convertible to a chair which, is disclosed in co-pending application Ser. No. 08/072,319, filed on Jun. 3, 1993 and assigned to the assignee of the present invention, the entire substance of which is hereby incorporated by reference herein.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

What is claimed is:

1. A hospital bed comprising:

a base;

a bed frame mounted above said base, said frame having spaced lateral sides;

a patient guard mounted on at least one of said lateral sides of said frame;

a linkage connecting said patient guard to said frame permitting said patient guard to be selectively moved laterally inwardly; and a latch for securing said patient guard in a laterally inward position, said latch comprising a cam block mounted on said frame, said cam block having a cam edge surface with a recess therein, and a latching arm having a handle at a first end and a rotatably mounted cam roller follower at a second end, said latching arm being pivotably mounted to said linkage between said roller follower and said handle, said latching arm being operable upon rotation of said latching arm by said handle to cause said roller follower to engage and translate along said cam edge surface and to move said patient guard inwardly until said roller follower engages said recess in said cam block, thereby removably securing said patient guard in said laterally inward position.

2. The hospital bed of claim 1 wherein said linkage comprises a parallelogram linkage having a carriage, said-patient guard being connected to said carriage, said parallelogram linkage having a pair of generally parallel links, each said link being pivotably connected to said carriage at a first link end and being pivotably connected to said frame at a second link end, and wherein said latching arm is pivotably mounted to said carriage.

3. A patient guard assembly adapted to be mounted to a hospital bed comprising:

a patient guard;

a linkage adapted to be connected to the hospital bed, said patient guard being connected to said linkage, said linkage permitting said patient guard to be selectively moved laterally inwardly; and a latch for securing said patient guard in a laterally inward position, said latch comprising a cam block adapted to be mounted to the bed, said cam block having a cam edge surface with a recess therein, and a latching arm having a handle at a first end and a rotatably mounted cam roller follower at a second end, said latching arm being pivotably mounted to said linkage means between said roller follower and said handle, said latching arm being operable upon rotation of said latching arm by said handle to cause said roller follower to engage and translate along said cam edge surface and to move said patient guard inwardly until said roller follower engages said recess in said cam block, thereby removably securing said patient guard in said laterally inward position.

4. The patient guard assembly of claim 3 wherein said linkage is a parallelogram linkage comprising a carriage and a pair of generally parallel links, each said link being pivotably connected to said carriage at a first link end and being pivotably connected to the bed at a second link end.

5. A hospital bed comprising:

a base;

a bed frame mounted above said base, said frame having spaced lateral sides;

a patient guard mounted on at least one of said lateral sides of said frame;

a linkage connecting said patient guard to said frame permitting said patient guard to be selectively moved laterally inwardly; and a latch for securing said patient guard in a laterally inward position, said latch comprising a plunger bracket mounted to said linkage, a plunger slidably mounted within said plunger bracket for movement between a retracted position within said plunger bracket and an extended position extending from said plunger bracket, a spring biasing said plunger toward said extended position, and a plate mounted on said linkage, said plate having an aperture adapted to receive said plunger therethrough, said plate being operable upon shifting of said patient guard laterally inwardly to cause said plunger to compress said spring and maintain said plunger in said retracted position until said aperture is aligned with said plunger thereby allowing said spring to extend and bias said plunger through said aperture into said extended position thereby removably securing said patient guard in said laterally inward position.

6. The hospital bed of claim 5 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to said frame at a second link end, said plunger bracket being mounted to said carriage, said plate being mounted to one of said links.

7. A patient guard assembly adapted to be mounted to a hospital bed comprising:

a patient guard;

a linkage adapted to be connected to the hospital bed said patient guard being connected to said linkage, said linkage permitting said patient guard to be selectively moved inwardly; and a latch for securing said patient guard in a laterally inward position, said latch comprising a plunger bracket mounted to said linkage, a plunger slidably mounted within said plunger bracket for movement between a retracted position within said plunger bracket and an extended position extending from said plunger block, a spring biasing said plunger toward said extended position, and a plate mounted on said linkage, said plate having an aperture adapted to receive said plunger therethrough, said plate being operable upon shifting of said patient guard laterally inwardly to cause said plunger to compress said spring and maintain said plunger in said retracted position until said aperture is aligned with said plunger thereby allowing said spring to extend and bias said plunger through said aperture into said extended position thereby removably securing said patient guard in said laterally inward position.

8. The patient guard assembly of claim 7 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to the bed at a second link end, said plunger bracket being mounted to said carriage, said plate being mounted to one of said links.

9. A hospital bed comprising:

a base;

a bed frame mounted above said base, said frame having spaced lateral sides;

a patient guard mounted on at least one of said lateral sides of said frame;

a linkage connecting said patient guard to said frame permitting said patient guard to be selectively moved to and between positions at a head end and a foot end of said bed; and a latch for securing said patient guard at a position intermediate to said head end and said foot end, said latch comprising a plunger bracket mounted to said linkage, a plunger slidably mounted within said plunger bracket for movement between a retracted position within said plunger bracket and an extended position extending from said plunger bracket, a spring biasing said plunger toward said extended position, and a block mounted on said frame, said block having an aperture to receive said plunger therethrough, said block being operable upon shifting of said patient guard to said intermediate position to cause said plunger to compress said spring and maintain said plunger in said retracted position until said aperture is aligned with said plunger, thereby allowing said spring to extend and bias said plunger through said aperture into said extended position thereby removably securing said patient guard in said intermediate position.

10. The hospital bed of claim 9 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to said frame at a second link end, and said plunger bracket being mounted to said carriage.

11. A patient guard assembly adapted to be mounted to a hospital bed comprising:

a patient guard;

a linkage adapted to be connected to the hospital bed, said patient guard being connected to said linkage, said linkage permitting said patient guard to be selectively moved to and between positions between a head end and a foot end of said bed; and a latch for securing said patient guard in a position intermediate to said head end and said foot end, said latch comprising a plunger bracket mounted to said linkage, a plunger slidably mounted within said plunger bracket for movement between a retracted position within said plunger bracket and an extended position extending from said plunger bracket, a spring biasing said plunger toward said extended position, and a block mounted on said frame, said block having an aperture to receive said plunger therethrough, said block being operable upon shifting of said patient guard to said intermediate position to cause said plunger to compress said spring and maintain said plunger in said retracted position until said aperture is aligned with said plunger, thereby allowing said spring to extend and bias said plunger through said aperture into said extended position thereby removably securing said patient guard in said intermediate position.

12. The patient guard assembly of claim 11 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to the bed at a second link end, said plunger bracket being mounted to said carriage, said block being mounted to one of said links.

13. A hospital bed comprising:

a base;

a bed frame mounted above said base, said frame having spaced lateral sides;

a patient guard mounted on at least one of said lateral sides of said frame;

a linkage connecting said patient guard to said frame permitting said patient guard to be moved to and between first, second and third positions, said first position being toward a head end of said bed, said second position being toward a foot end of said bed, said third position being intermediate said head and foot ends of said bed; and latching mechanism for removably securing said patient guard in said first, second and third positions.

14. The hospital bed of claim 13 wherein said latching mechanism comprises a cam block mounted on said frame, said cam block having a cam edge surface with a recess therein, and a latching arm having a handle at a first end and a rotatably mounted cam roller follower at a second end, said latching arm being pivotably mounted to said linkage between said roller follower and said handle, said latching arm being operable upon rotation of said latching arm by said handle to cause said roller follower to engage and translate along said cam edge surface until said roller follower engages said recess in said cam block, thereby removably securing said patient guard in said first position.

15. The hospital bed of claim 14 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to said frame at a second link end, and wherein said latching arm is pivotably mounted to said carriage.

16. The hospital bed of claim 13 wherein said latching mechanism comprises a plunger bracket mounted to said linkage, a plunger slidably mounted within said plunger bracket for movement between a retracted position within said plunger bracket and an extended position extending from said plunger bracket, a spring biasing said plunger toward side extended position, and a plate mounted on said linkage, said plate having an aperture to receive said plunger therethrough, said plate being operable upon shifting of said patient guard to said second position to cause said plunger to compress said spring and maintain said plunger in said retracted position until said aperture is aligned with said plunger, thereby allowing said spring to extend and bias said plunger through said aperture into said extended position thereby removably securing said patient guard in said second position.

17. The hospital bed of claim 16 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to said frame at a second link end, said plunger bracket being mounted to said carriage, said plate being mounted to one of said links.

18. The hospital bed of claim 13 wherein said latching mechanism comprises a plunger bracket mounted to said linkage, a plunger slidably mounted within said plunger bracket for movement between a retracted position within said plunger bracket and an extended position extending from said plunger bracket, a spring biasing said plunger toward said extended position, and a block mounted on said frame, said block having an aperture to receive said plunger therethrough, said block being operable upon shifting of said patient guard to said third position to cause said plunger to compress said spring and maintain said plunger in said retracted position until said aperture is aligned with said plunger, thereby allowing said spring to extend and bias said plunger through said aperture into said extended position thereby removably securing said patient guard in said third position.

19. The hospital bed of claim 18 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to said frame at a second link end, and said plunger bracket being mounted to said carriage.

20. A patient guard assembly adapted to be mounted to a hospital bed comprising:

a patient guard;

a linkage adapted to be connected to the hospital bed, said patient guard being connected to said linkage, said linkage permitting said patient guard to be moved to and between first, second, and third positions, said first position being toward a head end of the bed, said second position being toward a foot end of the bed, said third position being intermediate said head and foot ends of the bed; and latching mechanism for removably securing said patient guard in said first, second and third positions.

21. The patient guard assembly of claim 20 wherein said latching mechanism comprises a cam block adapted to be mounted to the bed, said cam block having a cam edge surface with a recess therein, and a latching arm having a handle at a first end and a rotatably mounted cam roller follower at a second end, said latching arm being pivotably mounted to said linkage between said roller follower and said handle, said latching arm being operable upon rotation of said latching arm by said handle to cause said roller follower to engage and translate along said cam edge surface until said roller follower engages said recess in said cam block, thereby removably securing said patient guard in said first position.

22. The patient guard assembly of claim 21 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to the bed at a second link end, and wherein said latching arm is pivotably mounted to said carriage.

23. The patient guard assembly of claim 20 wherein said latching mechanism comprises a plunger bracket mounted to said linkage, a plunger slidably mounted within said plunger bracket for movement between a retracted position within said plunger bracket and an extended position extending from said plunger bracket, a spring biasing said plunger toward said extended position, and a plate mounted on said linkage, said plate having an aperture to receive said plunger therethrough, said plate being operable upon shifting of said patient guard to said second position to cause said plunger to compress said spring and maintain said plunger in said retracted position until said aperture is aligned with said plunger, thereby allowing said spring to extend and bias said plunger through said aperture into said extended position thereby removably securing said patient guard in said second position.

24. The patient guard assembly of claim 23 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to the bed at a second link end, said plunger bracket being mounted to said carriage, said plate being mounted to one of said links.

25. The patient guard assembly of claim 20 wherein said latching mechanism comprises a plunger bracket mounted to said linkage, a plunger slidably mounted within said plunger bracket for movement between a retracted position within said plunger bracket and an extended position extending from said plunger bracket, a spring biasing said plunger toward said extended position, and a block adapted to be mounted to the bed, said block having an aperture to receive said plunger therethrough, said block being operable upon shifting of said patient guard to said third position to cause said plunger to compress said spring and maintain said plunger in said retracted position until said aperture is aligned with said plunger, thereby allowing said spring to extend and bias said plunger through said aperture into said extended position thereby removably securing said patient guard in said third position.

26. The patient guard assembly of claim 25 wherein said linkage comprises a parallelogram linkage having a carriage, said patient guard being connected to said carriage, said parallelogram linkage having a pair of generally parallel links, each said link being pivotably connected to said carriage at a first link end and being pivotably connected to the bed at a second link end, said plunger bracket being mounted to said carriage.

* * * * *